US011867005B1

(12) United States Patent
Yusuf

(10) Patent No.: US 11,867,005 B1
(45) **Date of Patent: *Jan. 9, 2024**

(54) OFFSHORE PLATFORM SLOT RECOVERY TOOL SYSTEM

(71) Applicant: Osman Yusuf, Hollywood Park, TX (US)

(72) Inventor: Osman Yusuf, Hollywood Park, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/860,621

(22) Filed: Jul. 8, 2022

Related U.S. Application Data

(63) Continuation of application No. 17/338,548, filed on Jun. 3, 2021, now Pat. No. 11,384,609.

(51) Int. Cl.

| | |
|---|---|
| ***E21B 19/16*** | (2006.01) |
| ***E21B 41/04*** | (2006.01) |
| ***E21B 17/08*** | (2006.01) |
| ***E21B 47/02*** | (2006.01) |
| ***E21B 33/043*** | (2006.01) |
| ***E21B 47/001*** | (2012.01) |
| ***E21B 23/14*** | (2006.01) |

(52) U.S. Cl.
CPC ..... *E21B 19/165* (2013.01); *E21B 41/04* (2013.01); *E21B 17/085* (2013.01); *E21B 23/14* (2013.01); *E21B 33/043* (2013.01); *E21B 47/001* (2020.05); *E21B 47/02* (2013.01)

(58) Field of Classification Search
CPC ..... E21B 19/165; E21B 41/04; E21B 17/085; E21B 23/14; E21B 33/043; E21B 47/001; E21B 47/02
See application file for complete search history.

(56) References Cited

U.S. PATENT DOCUMENTS

| | | | | |
|---|---|---|---|---|
| 3,851,491 | A * | 12/1974 | Mason | B63C 11/40 901/18 |
| 4,733,732 | A | 3/1988 | Lynch | |
| 5,297,638 | A | 3/1994 | Dolence, Jr. | |
| 11,384,609 | B1 * | 7/2022 | Yusuf | E21B 19/002 |

* cited by examiner

*Primary Examiner* — James G Sayre
(74) *Attorney, Agent, or Firm* — Law Office of Sam Sokhansanj PLLC

(57) ABSTRACT

An offshore platform slot recovery tool system and method. Here, the slot recovery tool system can include a body, wherein the body comprises a plurality of supports extending therefrom, wherein the plurality of supports are configured to engage an interior surface of a conductor pipe, and an articulating arm extending from the body, wherein the articulating arm is configured in either a stowed configuration or a deployed configuration. In addition, the articulating arm is further configured to couple to a seafloor oil well casing, such that the conductor pipe is moved in a direction away from the seafloor oil well casing.

16 Claims, 14 Drawing Sheets

OFFSHORE PLATFORM SLOT RECOVERY TOOL SYSTEM

CROSS-REFERENCE TO RELATED APPLICATION

This application is a continuation of U.S. Non-Provisional application Ser. No. 17/338,548 filed on Jun. 3, 2021, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Oil and gas wells exist either offshore or onshore. In offshore drilling there are two general theatres of operation, shallow water, which, depending on the environment, is considered all activities in less than 1000 feet of water depth, and deep water, which can be anything greater than 1000 feet of water depth. While water depths give a general indication, equipment types further describe the theatre of operation. For an equipment type to be considered deep water, a floating drilling and production platform and complex subsea wellhead and pipeline infrastructure is typical. However, in shallow water operations, fixed drilling and production platforms which are physically secured to the seafloor as opposed to floating are the norm, as well as surface/platform (above water) wellheads.

The aforementioned fixed and permanent structure for shallow water operations, which is also known as a production platform or jacket, is typically placed in a specified near vicinity location relative to the oil and gas field being produced, and secured/pinned to the seafloor. A production platform houses multiple wells from this single central structure, and a drilling template will designate the quantity, placement, and spacing of each well on the platform. For example, a total of 20 wells can be arranged in a rectangular configuration, 5 rows of 4 wells per row, spaced 10 feet apart from one another. At the surface, each well in the template will contain a well bay or slot, and from there extending down vertically aligned subsea guides will be placed at various depths to support the well all the way down to the seafloor. Therefore, the number of wells on a production platform is limited to the total slots available.

Typically, after all the wells on a platform have been drilled and completed or are otherwise occupied by an uncompleted or abandoned well, no more wells can be drilled from that specific platform. If an operator would like to thereafter drill a new well for whatever reason from this fully occupied platform, they would then need to either add an additional new slot with respective new subsea guides to the platform structure or reclaim one of the existing occupied old slots, a process which is commonly known as "slot recovery". The practice of adding an additional new slot and guides to an existing structure is very rare, being very difficult if not impossible due to the original structural design limitations of the platform, challenges of construction offshore on a live producing platform, underwater operation complications, platform permitting limitations and/or simply the high costs and risks involved. Therefore, slot recovery is more common and often times the only viable option.

There are various reasons for reclaiming a slot, which can include a setback during initial drilling operations leaving a slot unusable (debris, obstruction, collapsed pipe or being on a collision course), a dry hole (not finding oil or gas), low or diminished production from an existing completed well or even because a well has stopped producing altogether. Another more common reason is to drill a new well targeting a previously unreachable hydrocarbon reservoir, of which is now achievable due to modern technological advances in drilling that allow for deeper and longer wells. Regardless of the reason, in all instances for the slot to be considered occupied, at a minimum, the first and uppermost tubing in the well, also known as the conductor or drive pipe (large diameter casing), will physically occupy the slot, extending down vertically through all the guides all the way into the seafloor (mudline).

In conventional or prior art slot recovery methods and systems, in order to reclaim an existing occupied slot, the existing well first must be physically cut leaving a stump, wherein the old conductor and/or cemented inner casings can be pulled out and away of the guides and slot to free up the slot and guides. Next, the new conductor pipe will be installed in its place so further drilling can proceed. Due to slot spacing and guide alignment, when the new conductor pipe reaches the depth of the old well stump, the new conductor pipe must bypass the old well stump (which would otherwise be in its direct path through the guides), then be lowered into the seafloor creating a clear drilling trajectory for the new well. The location/depth for the old well cut and stump is predetermined to achieve ease of new conductor bypass along with the new well objectives in mind. If the stump is above the seafloor (above-mudline) in between guides, the platform guide spacing and inner diameter measurements are factored in when choosing the stump cutoff location/depth and new conductor pipe outside diameter. If the stump location/depth is below the seafloor or subterranean (sub-mudline), then the new conductor pipe outside diameter need not be larger than the inside diameter of the guides, and the guide spacing is not as important of a factor as the new conductor pipe will be past the final remaining guide once subterranean.

Specifically referring to the process of bypassing the old well stump in conventional or prior art slot recovery methods and systems, the most rudimentary method involves physical human intervention in the form of underwater divers, with the assistance of some type of surface cable and pulley setup to secure and push and/or pull the new conductor pipe to one side of the old well stump. This operation is nearly impossible if the stump is subterranean, and if the stump is above the seafloor, then it can be very expensive, risky, life-threatening to a diver, and time consuming, and is rarely if ever a viable option. Therefore, the most common method of slot recovery is the use of a whipstock in conventional slot recovery methods and systems. A whipstock, as it is commonly known in the oil and gas industry, is an angled steel wedge that is used to deflect a drill bit and/or casing in order to create a new well or borehole trajectory. While whipstocks are more common in downhole drilling applications, in slot recovery applications, a drivepipe whipstock is specifically used to deflect the new conductor pipe to one side and bypass the old well stump. Due to the non-standardized nature of offshore platforms and well designs, conventional drivepipe whipstocks are heavily engineered and custom tailored to suit each operation, requiring early planning and long manufacturing lead times. In addition, the large size (10'-30' long and 1-5 tons in weight) make logistics both complicating and expensive. Operationally, the conventional drivepipe whipstock has a very low probability of success. For example, a few common problems being platform guide hang ups, premature drivepipe separation, old well stump engagement complications, and lack of directional control of the new drivepipe. In addition, the conventional drivepipe whipstock is a single use consumable item that cannot be retrieved and re-used.

Hence, what is needed is an apparatus, system and/or method of offshore platform slot recovery that is compact, universally adaptable, remotely operated, retrievable and allows a new conductor pipe to bypass an old well stump and track a desired azimuth and inclination.

BRIEF SUMMARY

The disclosure described herein addresses the deficiencies and shortfalls of the aforementioned conventional systems and methods. Particularly, in one aspect of the disclosure described herein, a slot recovery tool ("SRT") apparatus can be pre-installed onto the inner diameter of a conductor pipe, offline, prior to tubular running operations. Prior to tubular running operations, the SRT apparatus can be in the unset position with its extendable legs retracted, such that the body of the SRT apparatus has a smaller outside diameter relative to the inside diameter of the conductor pipe the SRT apparatus is being deployed therein, to allow movement within the inside of the conductor pipe. Once inside the conductor pipe and the SRT is in the proper position at the bottom of the conductor pipe, its legs can expand and extend outward to a secure the SRT within the inside of the conductor pipe. Here, the teethed or grooved foot pads of the SRT can abut and contact the inside wall of the conductor pipe, thereby securing the SRT in place within the pipe. In addition, the conductor pipe can be prepared with a dovetail fin attachment of the SRT apparatus.

Here, the dovetail fin can be attached to the outer wall of the conductor pipe, parallel (vertically) with the direction of the pipe bore. In addition, the dovetail fin is further embedded with a sensor that is capable of measuring and transmitting location, azimuth, and inclination data. Now, the conductor pipe, paired with the dovetail fin along its outside with the SRT apparatus secured to its inside bottom, is lowered (or run) down through the platform slot guides until the conductor pipe reaches the old well stump. Once there, the conductor pipe is rotated to a pre-determined desired azimuth (heading) of which is indicated by the position of the sensor that is embedded within the dovetail fin, wherein this step helps to achieve the new well objective and target.

Here, while the SRT apparatus is being remotely controlled via an umbilical or communication line or wires (or wirelessly), and also having multiple cameras for visuals from all necessary angles, the SRT engages its manipulator arm. Here, the manipulator arm extends down and out of the main central housing of the SRT apparatus, whereby the arm is free of any obstructions and clear of the bottom of the conductor pipe. In operation, the manipulator arm can grasp the stump block and stump lasso (or retrieval member), and positively engage the top circumference or outer perimeter of the stump with the lasso. Once positive engagement is confirmed via the arm, the opening of the lasso is tightened and constricted tightly around the stump block, thereby securing the stump block to the stump. At this time, the manipulator arm is re-engaged and can bend at its elbow accordingly to move the conductor pipe laterally, sideways, or transversely to another side or region that is free and clear of the stump towards the stump block.

Once free and clear of the stump, the manipulator arm moves and further pulls the conductor pipe down where the dovetail fin (male section) is mated with the dovetail cutout (female section) of the stump block. Once positive engagement of the conductor pipe and dovetail fin and the stump and stump block with dovetail cutout is confirmed, the manipulator arm releases the stump block. Next, the manipulator arm can fold back accordingly and retract into the housing for the manipulator arm of the SRT apparatus. The SRT apparatus can now unset and disengage the conductor pipe by retracting its legs and foot pads from the inner wall of the conductor pipe. Next, the SRT apparatus can then be retrieved and pulled up and out of the conductor pipe via its umbilical, communication line, and/or wireline. At this stage, the new conductor pipe has bypassed the old well stump and is positively secured to the fixed dovetail block via the dovetail fin to maintain its azimuth and inclination. Finally, the conductor pipe can be lowered into the seafloor in a controlled and predictable manner, where the specified well target azimuth and inclination is achieved. And accordingly, the slot has been successfully recovered via the SRT apparatus, method, and system of the disclosure described herein and further piling and/or drilling operations may commence.

In another aspect of the disclosure described herein, the SRT apparatus may be installed into the conductor pipe after tubular running operations. Here, the conductor pipe, having been prepared with the dovetail fin, can be lowered down (or run) into and through the platform slot and guides until it has reached the old well stump. The SRT apparatus can then be placed inside the inner diameter of the conductor pipe at the platform surface (rig floor), and lowered via the umbilical, communication line, and/or wireline until it reaches the inner bottom of the conductor pipe. Once there it can extend its legs to the set position where the toothed foot pads fasten the tool in place.

In another aspect of the disclosure described herein, the SRT apparatus can be controlled wirelessly from any location. In another aspect of the disclosure described herein, the SRT apparatus and/or the stump block of the SRT apparatus can be embedded with a sensor able to measure and transmit location, azimuth, and inclination. In another aspect of the disclosure described herein, a clamp-style stump block can be used to secure the old well stump at its uppermost. The clamp-style stump block is placed on top of the old well stump, and the downward facing clamp is used to positively engage inside of the old well stump, as well as outside the old well stump, where it will squeeze to clamp to the uppermost of the stump. The process of bypassing an old well stump to recover a slot can further be achieved with a compact, universally adaptable, remotely operated, retrievable slot recovery tool that allows a new conductor pipe to bypass an old well stump and track a desired azimuth and inclination. The foregoing can be accomplished in less time than the conventional prior art method involving a drivepipe whipstock.

In another aspect of the disclosure described herein, a method of deploying an SRT assembly is disclosed that can be installed inside the bottom of a conductor pipe, thereby allowing a manipulator arm to extend down and out of the conductor pipe to engage the old well stump in order to pull the conductor pipe laterally thereby allowing the conductor pipe to bypass the old well stump. Here, a dovetail fin embedded with a sensor able to measure and transmit location, azimuth and inclination is secured to the outside of the conductor pipe, which is further used to mate to the dovetail cutout of the stump block. The method can include a stump block with a dovetail cutout. Here, a stump lasso is used to positively engage and secure the old well stump. Furthermore, the method can include a clamp-style stump block which is used to positively engage and secure the old well stump.

In another aspect of the disclosure described herein, an offshore platform slot recovery tool system is disclosed having a body, wherein the body comprises a plurality of supports extending therefrom, wherein the plurality of supports are configured to engage an interior surface of a conductor pipe. The system can also include an articulating arm extending from the body, wherein the articulating arm is configured in either a stowed configuration or a deployed configuration, and wherein the articulating arm is further configured to couple to a seafloor oil well casing, such that the conductor pipe is moved in a direction away from the seafloor oil well casing. Here, the conductor pipe may include a male securement member secured to its exterior surface. In addition, the articulating arm can include a female securement member configured to receive the male securement member of the conductor pipe therein. Further, the male securement member can include one or more sensors that are capable of measuring or capturing, and transmitting location, azimuth, and inclination data via network. Here, the body or articulating arm may include one or more cameras or sensors that are capable of capturing video, location, azimuth, and inclination data, and transmitting such data over a network. In addition, wherein each of the extendable supports further comprise feet or gripping members at their distal ends.

The offshore platform slot recovery system may also include a communication cord or line secured to a top region of the body, wherein the cord or line is configured to operate and retrieve the body. Here, the articulating arm can further include a first securement member coupled thereto, wherein the securement member engages the seafloor oil well casing. In addition, the securement member can be a looped opening configured to encircle and secure an outer surface of the seafloor oil well casing. In addition, the securement member can be a clamp, gripper, or forceps configured to grasp and secure an inner and outer and uppermost surface of the seafloor oil well casing. Further, the articulating arm can be configured to decouple from the securement member.

In another aspect of the disclosure described herein, an offshore platform slot recovery tool method is disclosed. The method can include lowering a body within a conductor pipe, wherein the body includes a plurality of supports extending therefrom, and operating the plurality of extendable supports such that they engage an interior surface of the conductor pipe. The method can further include operating an articulating arm that extends from the body, and deploying the articulating arm such that it couples to a seafloor oil well casing, wherein the conductor pipe is moved in a direction away from the seafloor oil well casing via the articulating arm. Here, the conductor pipe can be a male securement member secured to its exterior surface. The method can also include the step of receiving, via a female securement member, the male securement member of the conductor pipe. In addition, the method can include obtaining location, azimuth, and inclination data from one or more cameras or sensors in order to align the male and female securement members for engagement. The method can also include operating and retrieving the body via a cord or line secured to a top region of the body. The method may also include engaging the seafloor oil well casing via a first securement member coupled to the articulating arm, and decoupling the first securement member from the articulating arm.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1A:
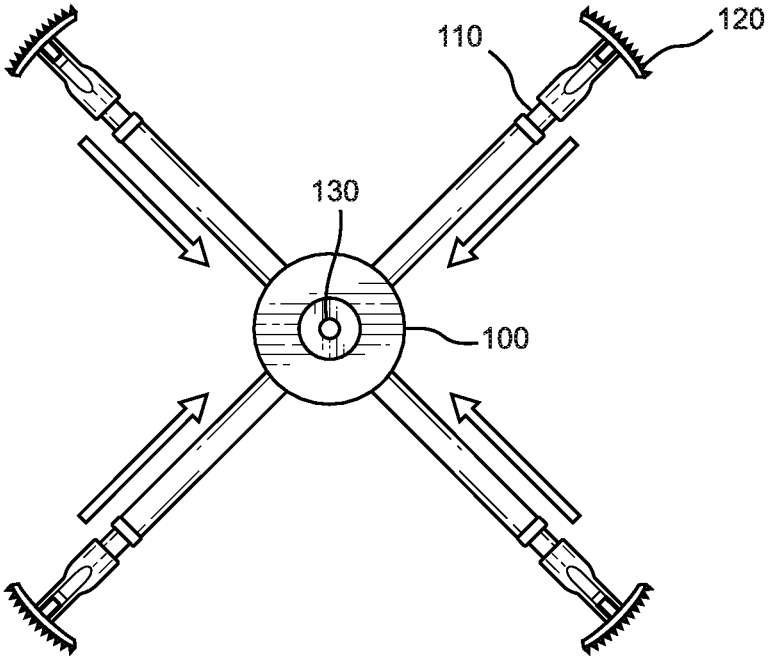
FIG. 1A illustrates a top view for one non-limiting exemplary embodiment of an SRT apparatus of the disclosure described herein, illustrating its legs and foot pads in a retracted position.

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Phrases and terms similar to "software", "application", "app", and "firmware" may include any non-transitory computer readable medium storing thereon a program, which when executed by a computer, causes the computer to perform a method, function, or control operation.

Phrases and terms similar "network" may include one or more data links that enable the transport of electronic data between computer systems and/or modules. When information is transferred or provided over a network or another communications connection (either hardwired, wireless, or a combination of hardwired or wireless) to a computer, the computer uses that connection as a computer-readable medium. Thus, by way of example, and not limitation, computer-readable media can also comprise a network or data links which can be used to carry or store desired program code means in the form of computer-executable instructions or data structures and which can be accessed by a general purpose or special purpose computer.

FIGS. 1A-2B illustrate various views for one non-limiting exemplary embodiment of the SRT apparatus 100 of the present disclosure described herein. Here, SRT apparatus 100 can include a central housing, casing, or body that can be further connected to and suspended from an umbilical, communication line, or wireline 130, wherein the SRT can receive and transmit instructions with respect to its remote operation via line 130. SRT apparatus 100 can further include a plurality of extendable legs 110, which can be attached to the central housing at one end, and further integrated with teethed or grooved curved foot pads 120 at the other end. Here, each pair of legs 110 may be supported by a fin, vane, or bracket between them for structural support. In particular, foot pads 120 can have generally curved outer surface with a plurality of teeth, fin, protrusions, spikes, or grooves for securement purposes. Here, extendable legs 110 can extend or retract to allow foot pads 120 to securely abut the interior wall surface of a conductor pipe, such as conductor pipe 200.

Figure 1B:
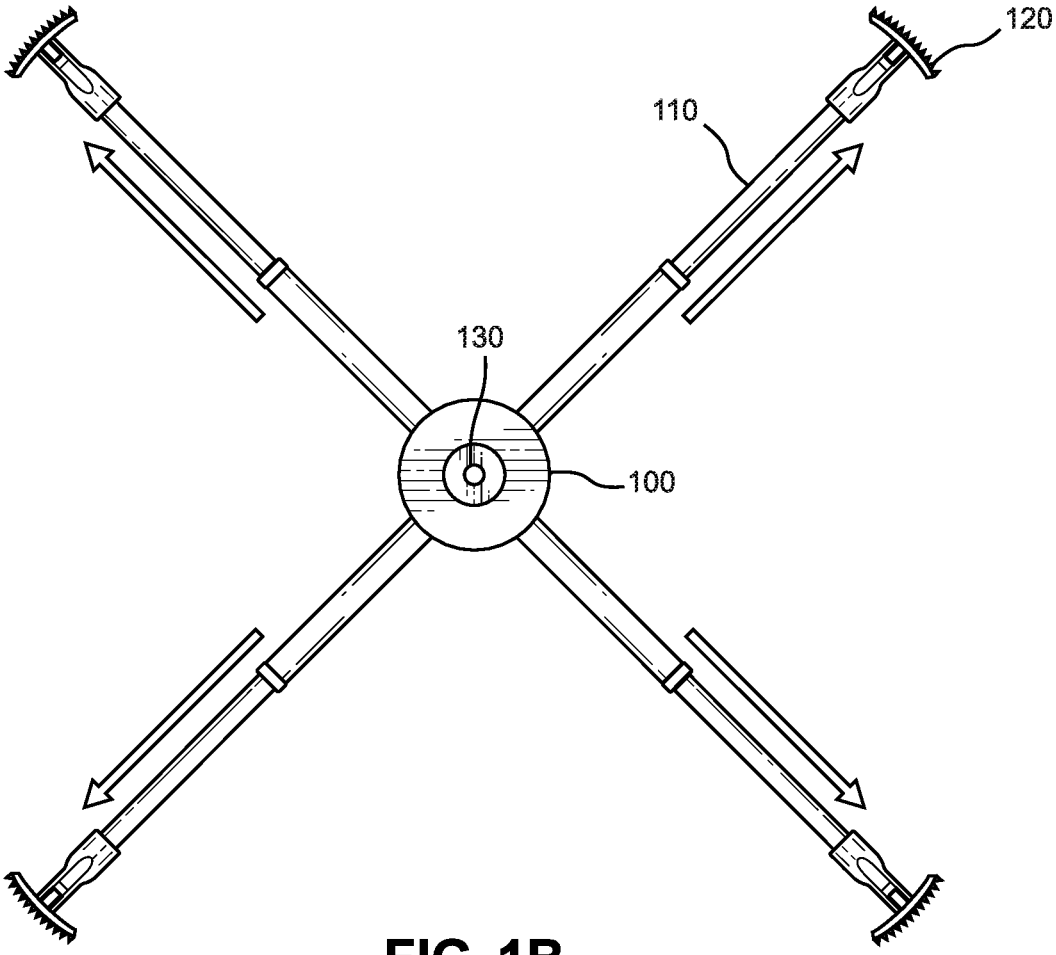
FIG. 1B illustrates a top view of the SRT apparatus of FIG. 1A, illustrating its legs and extended securing legs and foot pads in an extended position.
Figure 1C:
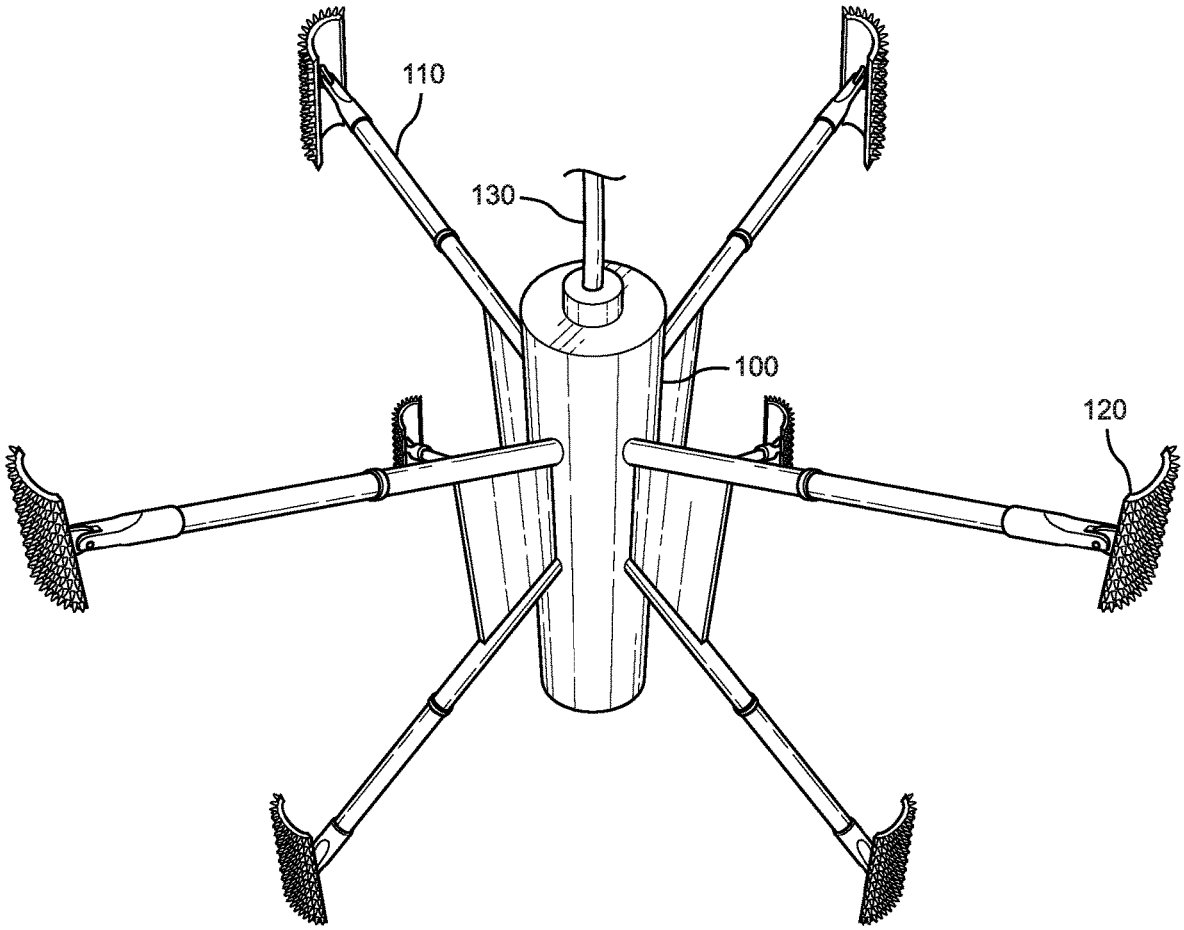
FIG. 1C illustrates a perspective top view of the SRT apparatus of FIG. 1B, further illustrating its legs and foot pads in an extended position.

Further, FIG. 1A depicts the extendable legs 110 in a fully retracted configuration, and FIG. 1B depicts the extendable legs 110 in a fully expanded configuration. It is contemplated within the scope of the present disclosure described herein that SRT 100 apparatus may include any number of extendable legs 110, depending on the application and deployment of the SRT apparatus. In addition, the size, length, and extendable range of the extendable legs 110 for SRT apparatus 100 can include length to cover the various tubular pipe inner diameter applications common in such operations. For example, the typical minimum size outside diameter of a conductor pipe (surface casing) common in well designs is about 20 in., and the typical maximum being about 36 in. outside diameter. Therefore, in one embodiment, for exemplary purposes, the extendable legs 110 could extend and retract at least about 16 in. in length to cover the range necessary to secure to the interior wall space of any size conductor pipe from a 20 in. outside diameter up to a 36 in. outside diameter and all sizes in between. Accordingly, the most common size for a conductor pipe having a 30 in. outside diameter would fall within the disclosed range.

Figure 2A:
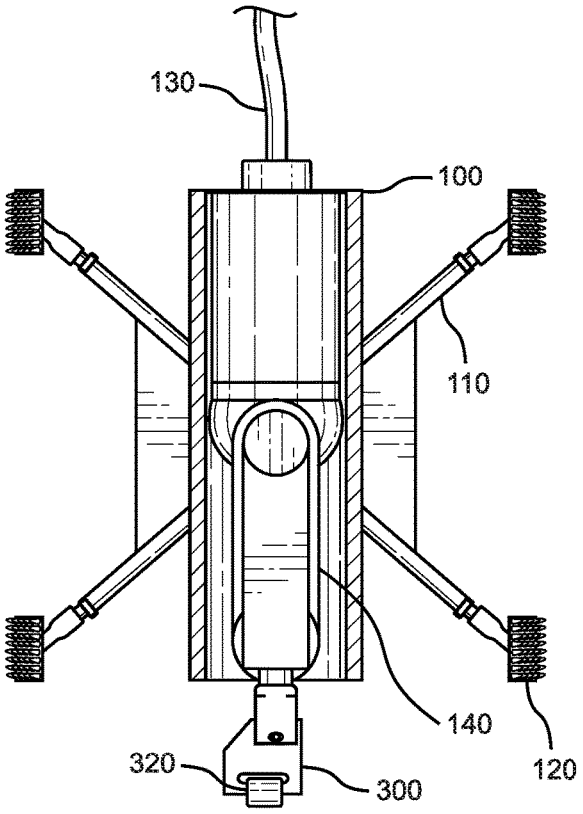
FIG. 2A illustrates a partial cross-section view of the SRT apparatus of FIG. 1A, illustrating its manipulator arm retracted therein.
Figure 2B:
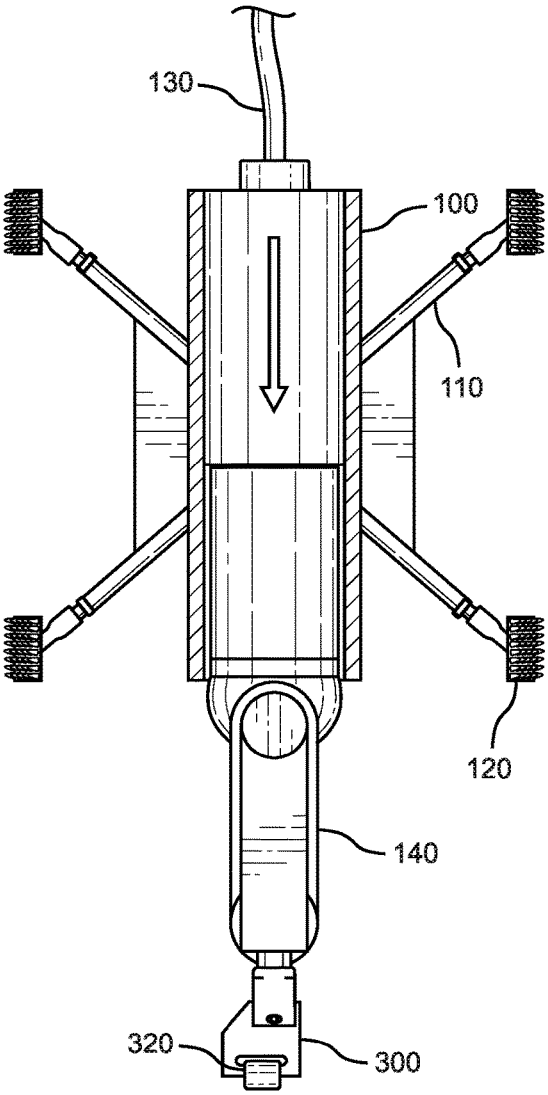
FIG. 2B illustrates a partial cross-section view of the SRT apparatus of FIG. 1A, illustrating its manipulator arm extended therefrom.

Still referring to FIGS. 1A-2B, SRT apparatus 100 is further shown with manipulator arm 140. For example, FIG. 2A illustrates the arm 140 disposed within SRT apparatus 100 in a retracted and stowed configuration, and FIG. 2B illustrates arm 140 in an extended and operational configuration. In addition, arm 140 further includes a stump block bracket 300 that is further secured to a lasso securement member 320, wherein the lasso 320 can operate to open and close its opening to diameter that is slightly larger than the diameter of the old well stump in order to encircle and secure the old well stump. Here, lasso 320 can also be referred to herein as a clamp or gripper. Further, the lasso 320 can be any type of a catch having a noose or a looped opening that can be constricted or reduced in size to secure an object. In particular, lasso 320 can be any type of a wire line, steel belt, rope, or clamp that can remain substantially horizontal while suspended, and wherein its opening is capable of being reduced in size, such as being wound in or wounded out. Lasso 320 may also be mechanically or electrically actuated and operated via mechanical geared spool, and a claw of the stump block holding it would have the ability to turn the gear of the spool.

FIGS. 3-8 illustrate one non-limiting exemplary embodiment for a method of operation of the SRT apparatus 100 of the present disclosure described herein, wherein the lasso 320 is secured to the outer surface of the old well stump 400. Here, at FIG. 3, the SRT apparatus 100 is shown subsea and secured to the inside of a conductor pipe 200 via its legs 110 extended and foot pads 120 abutting the interior wall of the conductor pipe, and connected at its uppermost region by an umbilical 130. In particular, the curved foot pads 120 are in a secured position as they abut against the interior wall of the conductor pipe 200 by having the extendable legs 110 in the extended position. Further, the conductor pipe 200 has been prepared with a dovetail fin 210 of the SRT apparatus, passed vertically through a platform guide 510 which is supported by a platform 500 and having reached the old well stump 400 shown above the seafloor 600.

Figure 3:
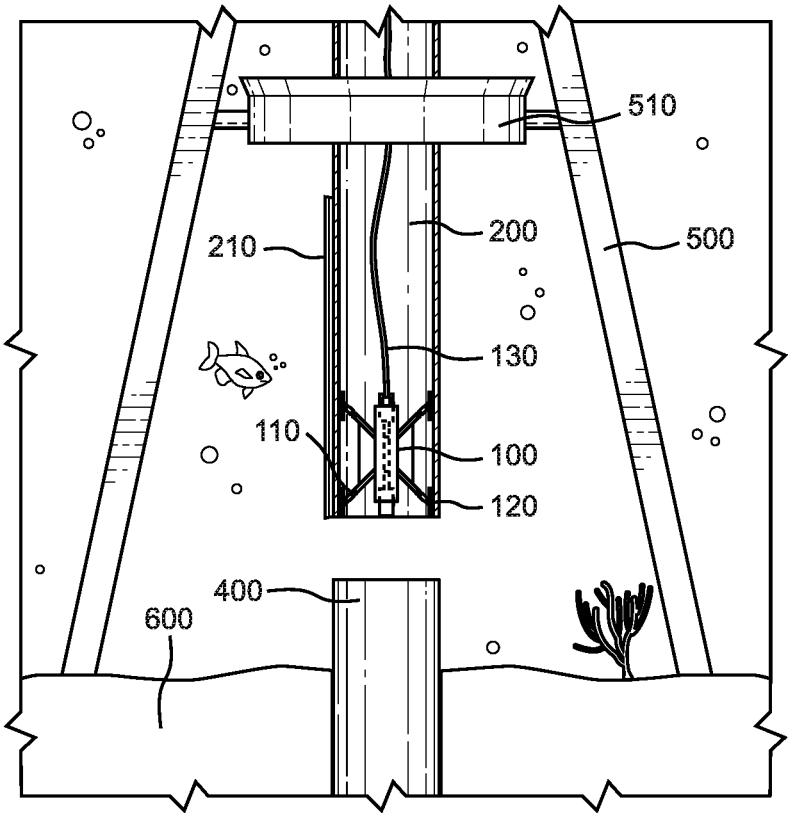
FIGS. 3-8 illustrate partial cross-section views of the SRT apparatus of FIGS. 1A-1B and a conductor pipe and old well stump, further illustrating one non-limiting exemplary embodiment for a method of operation of the SRT apparatus and manipulator arm of the disclosure described herein with respect to a conductor pipe and old well stump.
Figure 4:
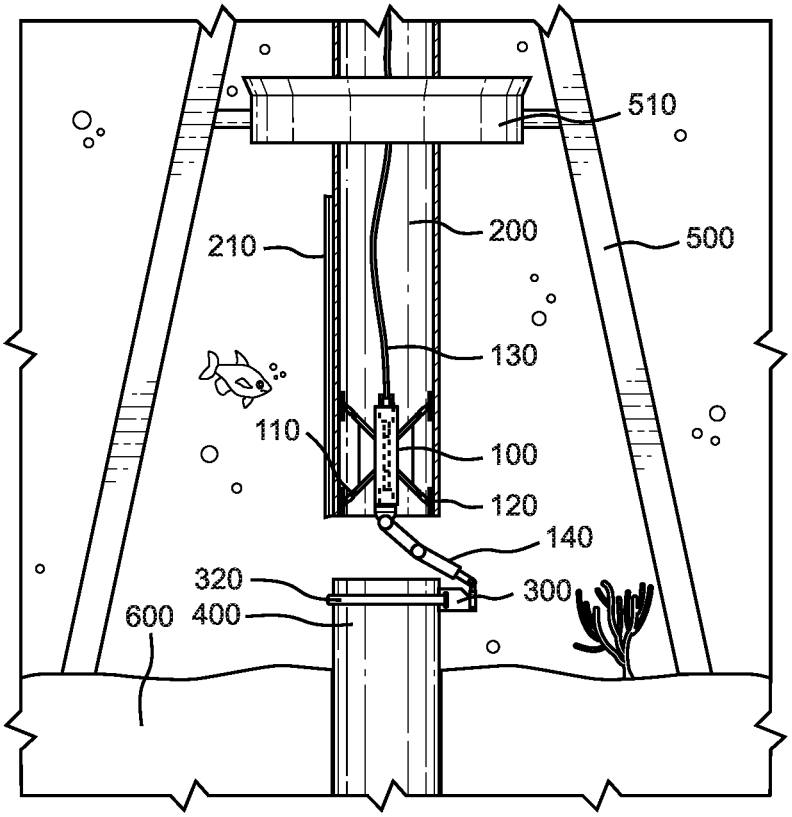
Figure 5:
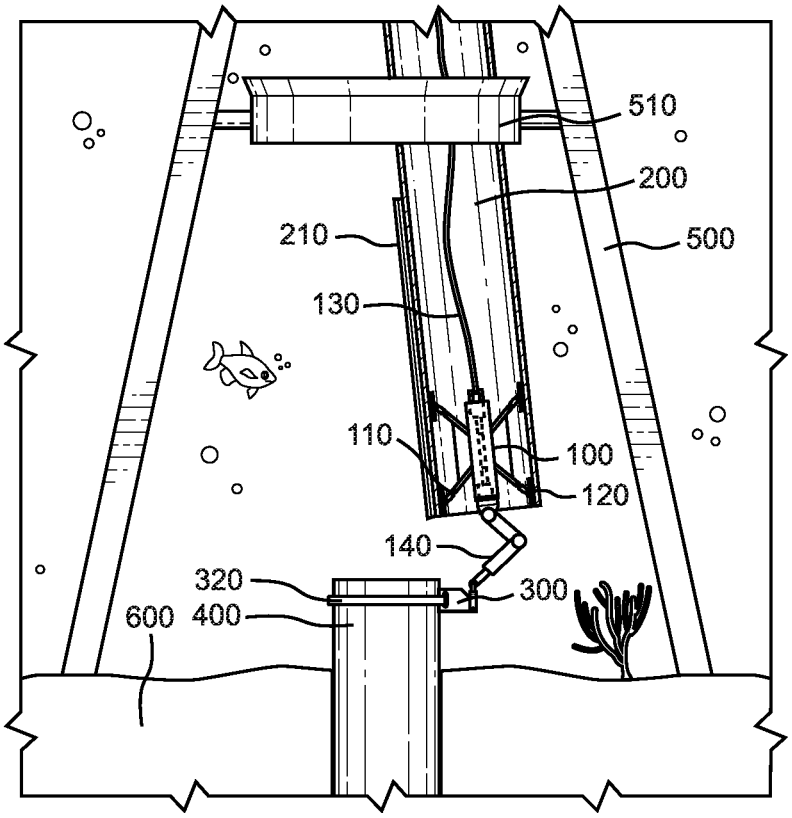
Figure 6:
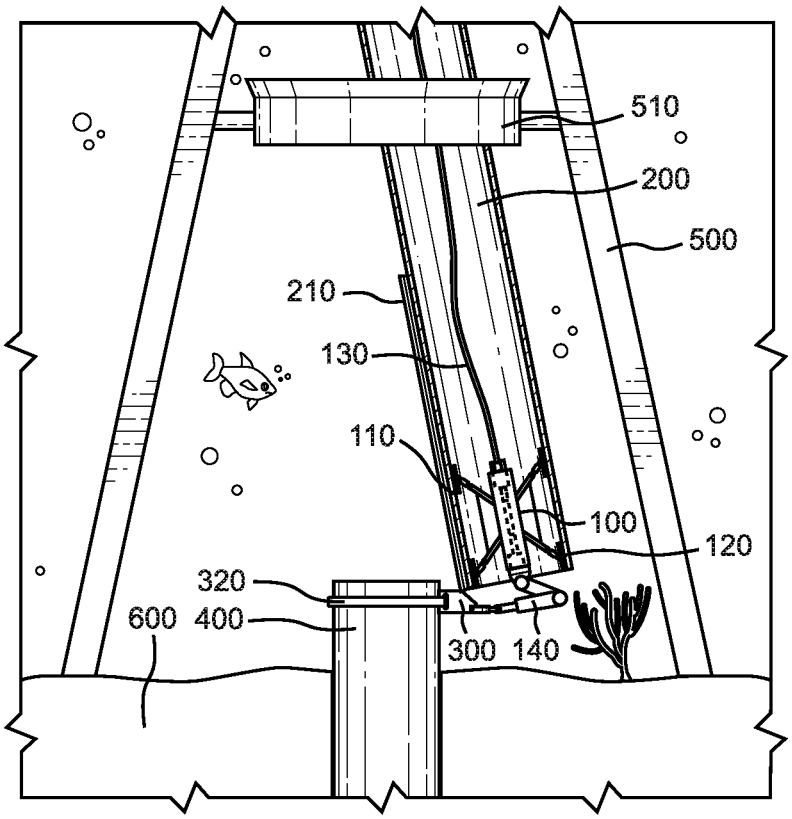
Figure 9A:
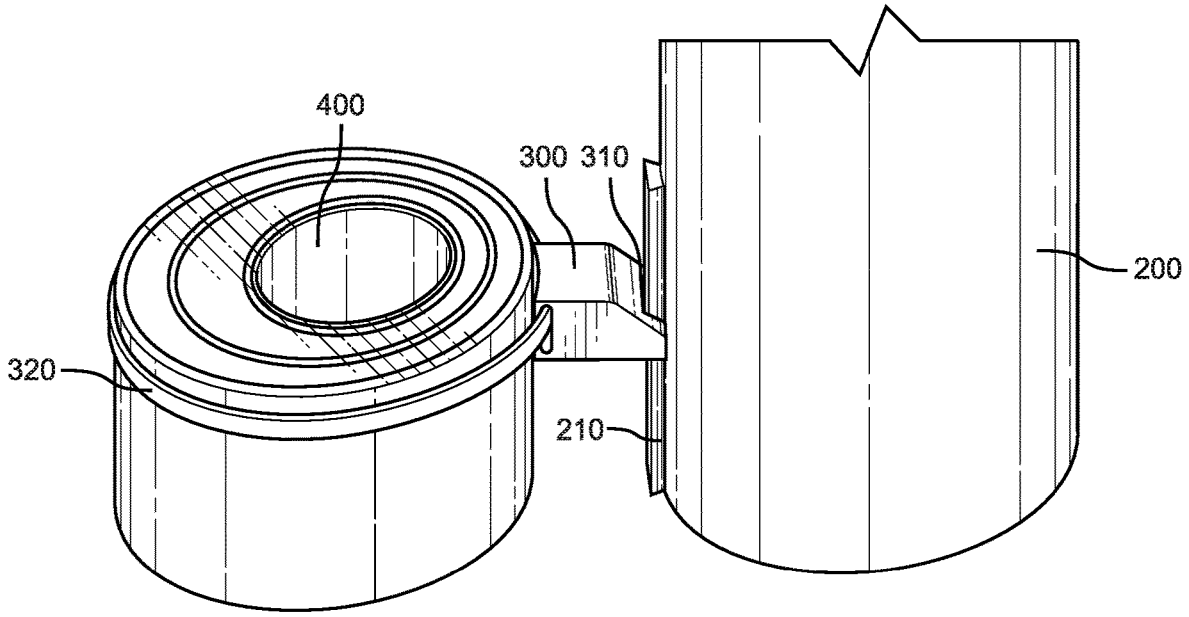
FIG. 9A illustrates a perspective side view of the conductor pipe and with a dovetail cutout mated with the dovetail fin of the stump block, thereby bypassing the old well stump, with respect to the method operation shown in FIGS. 3-8.
Figure 9B:
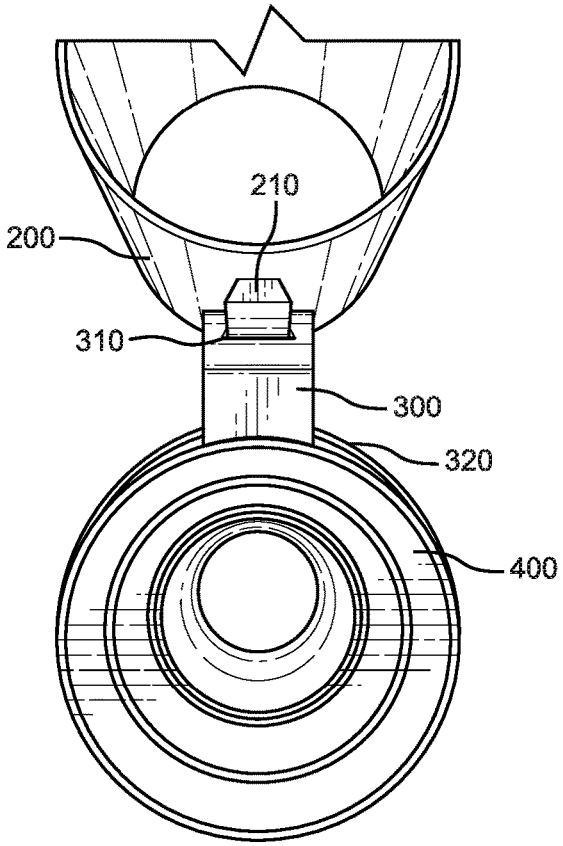
FIG. 9B illustrates a perspective top view of FIG. 9A.

Still referring to FIG. 3, the conductor pipe 200 has been prepared and fitted with a dovetail fin 210 of the SRT apparatus on its outer exterior and passed vertically through a platform guide 510 which is supported by a platform 500 and having reached the old well stump 400 which is shown above the seafloor 600. Here, platform guide 510 assists in positioning the conductor pipe near the general vicinity of (or centered with) the old well stump 400. Next, as shown in FIG. 4, the manipulator arm 140 can then be actuated, which further actuates the lasso 320 of stump block 300 in order to encircle and secure itself to the outer surface of old well stump casing 400. Next, as shown in FIG. 5, the manipulator arm 140 can then be actuated to articulate its arm in order to bend at a joint or elbow thereby moving and pivoting the conductor pipe 200 laterally, transversely, angularly, or sideways to clear and bypass the old well stump 400. Next, as shown in FIG. 6, the manipulator arm 140 can then actively pull the conductor pipe 200 in a downward angled direction to mate or engage the dovetail fin 210 with that of the dovetail cutout, groove, or channel 310 of the stump block 300. Here, it is contemplated within the scope of the disclosure that various cameras or proximity sensors may be deployed on the body of SRT 100 (or in the vicinity thereof) to allow an operator (or autonomous system) to accurately align the fin 210 with that of cutout 310. Specifically, as shown in FIGS. 9A-9B, dovetail cutout 310 can be comprised of a channel or groove female member having a triangular, trapezoidal, or spherical cross-section configuration that corresponds with a same or similar triangular, trapezoidal, or spherical configuration male member of fin 210. Moreover, the opening of cutout 310 may also be slightly larger to allow for easier engagement with fin 210, but still prevent fin 210 to be pulled or slid out of cutout 310 during the slot recovery operations disclosed herein.

Figure 7:
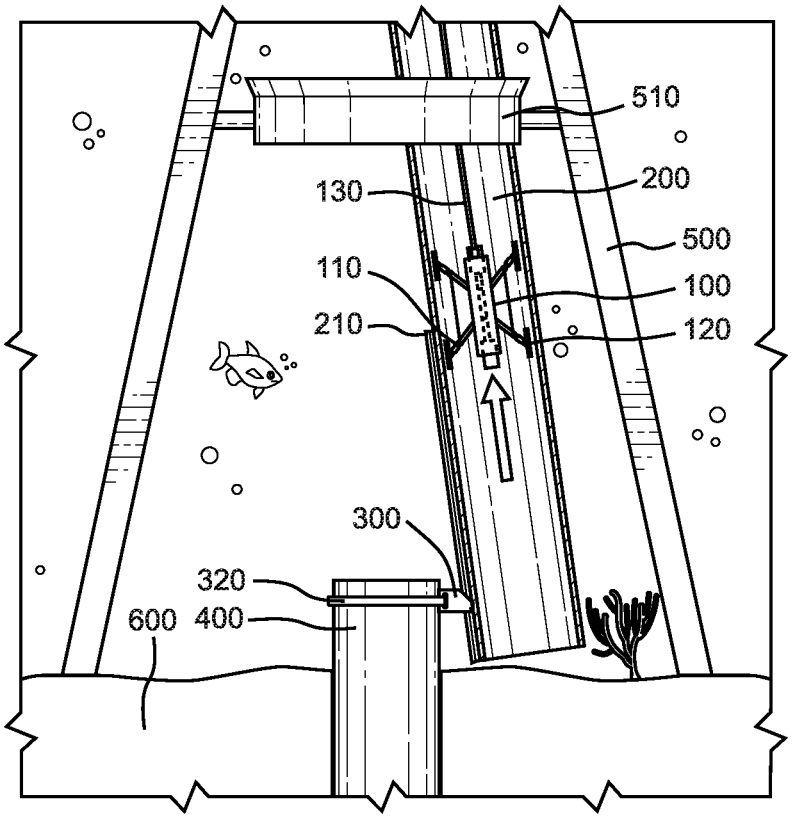
Figure 8:
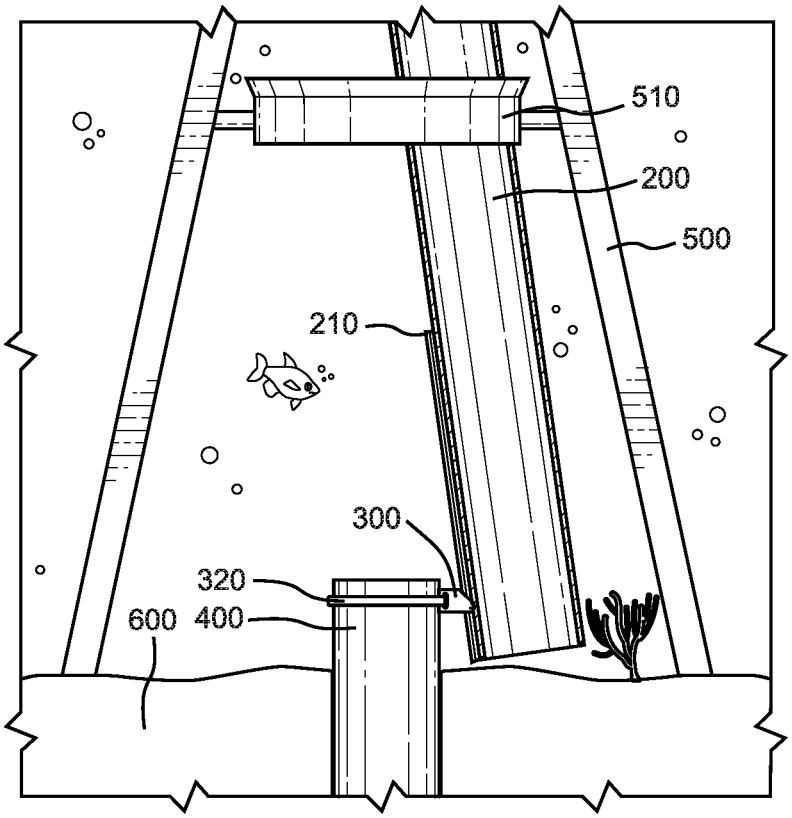

Next, as shown in FIG. 7, once the conductor pipe 200 with dovetail fin 210 is mated or secured to the dovetail cutout 310 of the stump block 300, bypassing the old well stump 400, then SRT apparatus 100 can then be retrieved. In particular, FIG. 7 shows arm 140 of the SRT apparatus 100 disengaged and decoupled from the stump block 300. Next, its extendable legs 110 are retracted and the foot pads have detached or disengaged from the interior wall space of the conductor pipe 200. Next, the SRT apparatus 100 body can then be pulled up and out of the conductor pipe 200 to the surface by the umbilical 130. In particular, FIG. 8 shows the completed operation of the disclosure described herein of the conductor pipe 200 with dovetail fin 210 mated with the dovetail cutout of the stump block 300, bypassing the old well stump 400, and the SRT apparatus 100 is completely retrieved and no longer visible. Here, as shown in FIG. 8, it is noted there will generally be an angle (inclination) to conductor pipe 200 at the completion of operations, because the new conductor cannot occupy the same space as the old well stump, among other reasons.

FIGS. 9A-9B illustrate various views for the dovetail fin 210 engaged and secured to the stump block 300 of the present disclosure described herein, wherein the fin 210 is slid through opening cutout 310 of the stump block 300. In addition, lasso 320 is shown encircling an securing the outer casing of stump well 400, wherein well 400 is comprised of multiple tubular casings cemented together.

FIGS. 10-15 illustrate another non-limiting exemplary embodiment for a method of operation of the SRT apparatus 100 of the present disclosure described herein, wherein a clamp 330 or gripper 330 is secured to the inner and outer surface of the old well stump 400. Here, at FIG. 10, the SRT apparatus 100 is shown subsea and secured to the inside of a conductor pipe 200 via its legs 110 extended and foot pads 120 abutting the interior wall of the conductor pipe, and connected at its uppermost region by an umbilical 130. In particular, the curved foot pads 120 are in a secured position as they abut against the interior wall of the conductor pipe 200 by having the extendable legs 110 in the extended position. Further, the conductor pipe 200 has been prepared with a dovetail fin 210 of the SRT apparatus, passed vertically through a platform guide 510 which is supported by a platform 500 and having reached the old well stump 400 shown below the seafloor 600.

Figure 10:
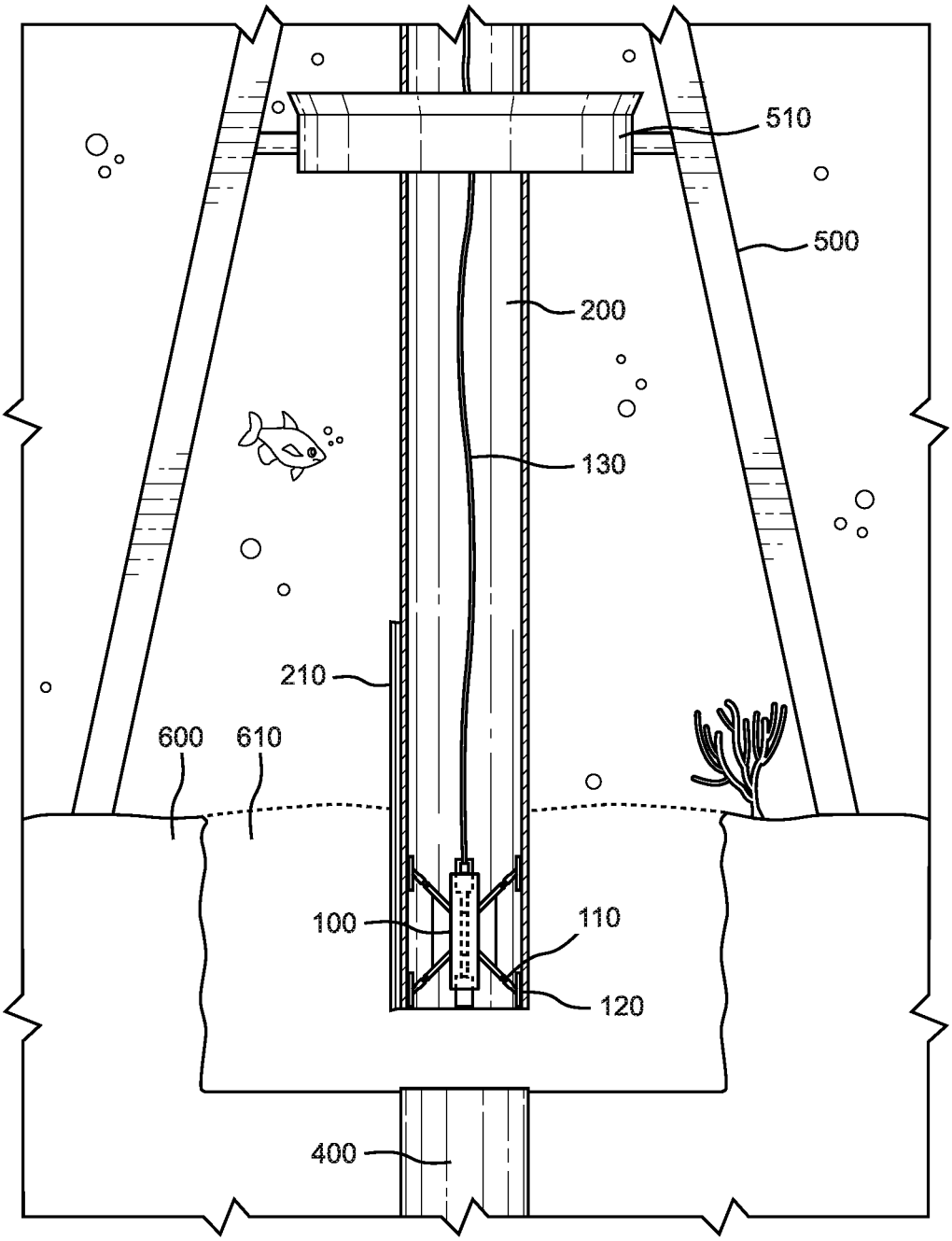
FIGS. 10-15 illustrate partial cross-section views of the SRT apparatus of FIGS. 1A-1B and a conductor pipe and old well stump, further illustrating another non-limiting exemplary embodiment for a method of operation of the SRT apparatus and manipulator arm of the disclosure described herein with respect to a conductor pipe and old well stump.
Figure 11:
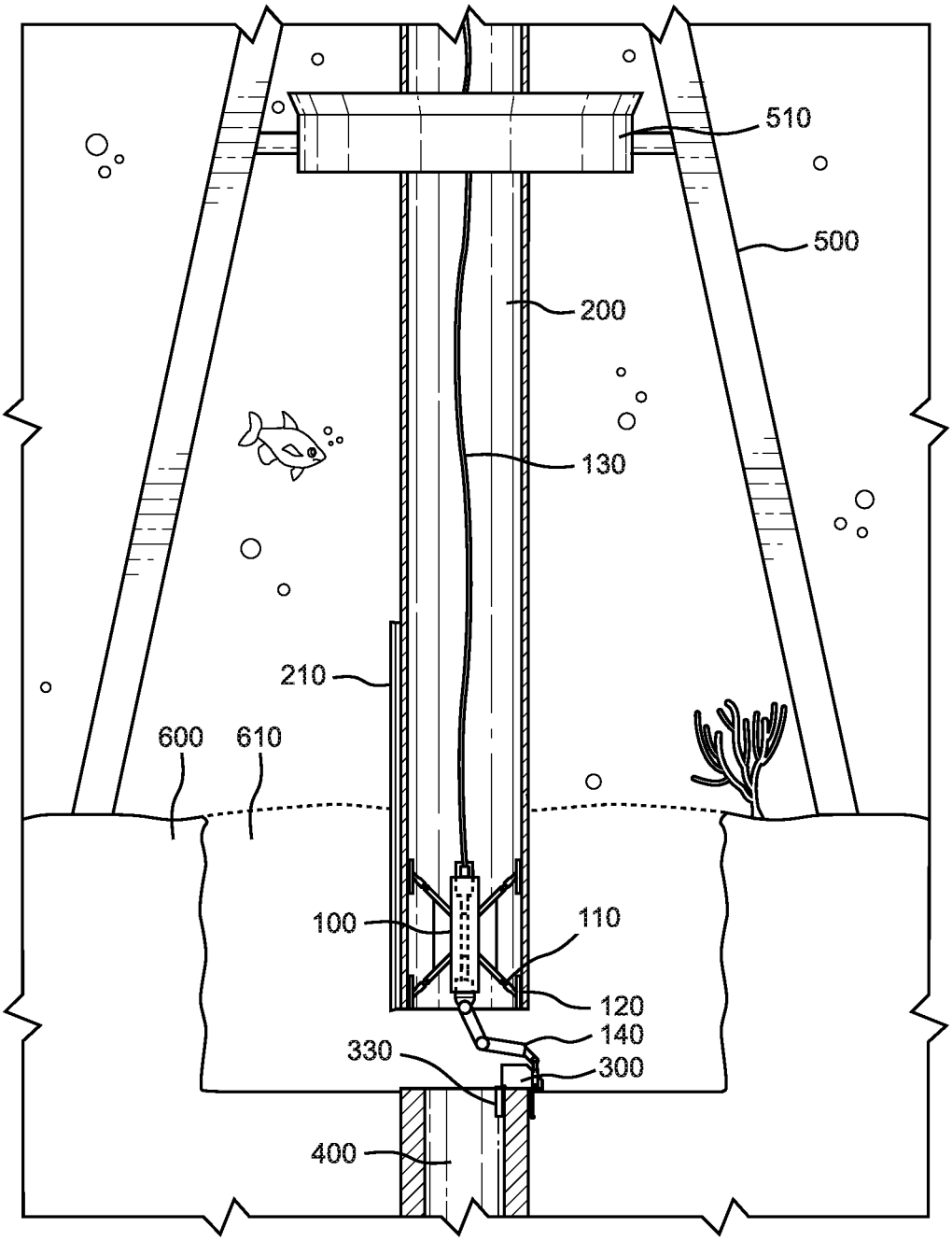
Figure 12:
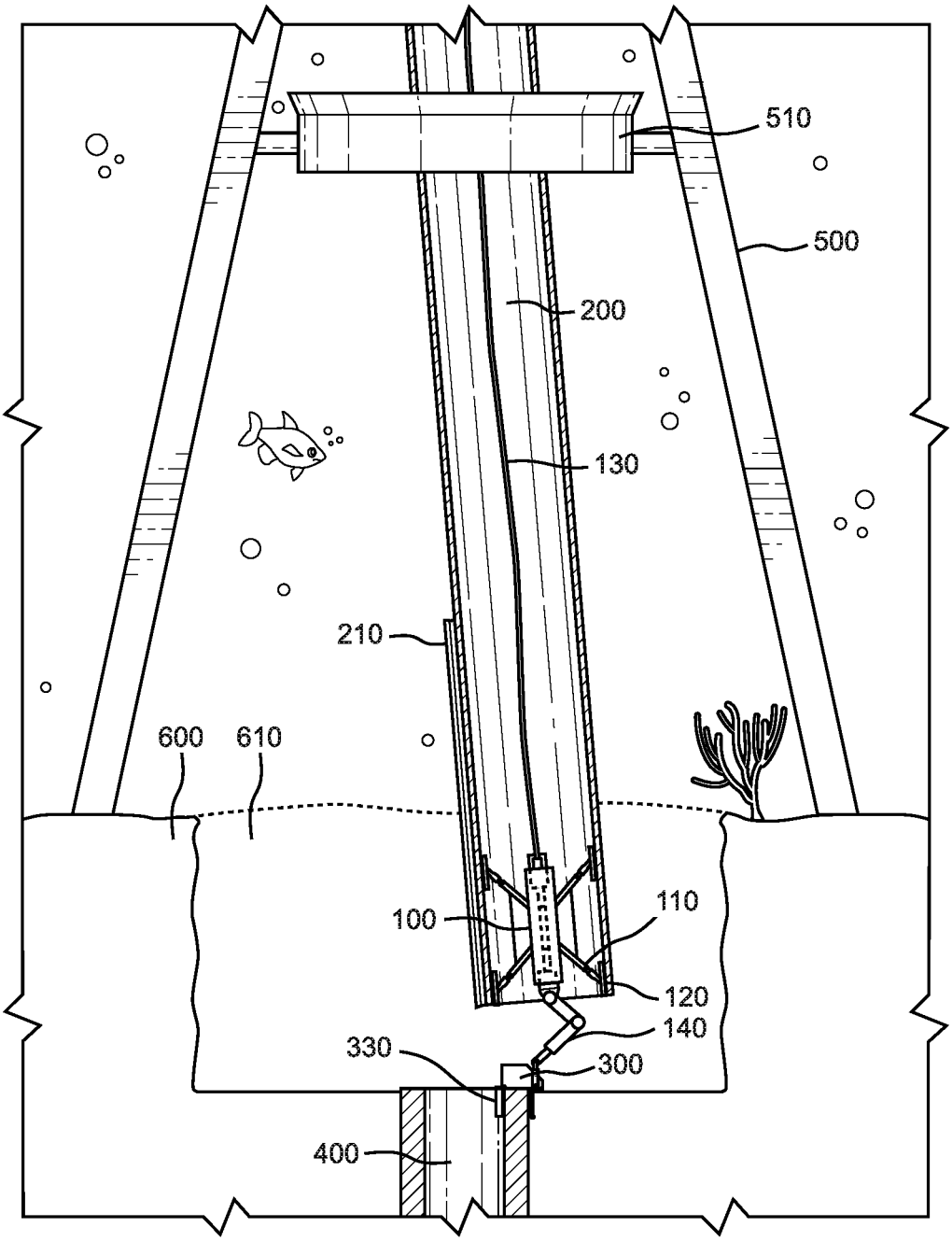
Figure 13:
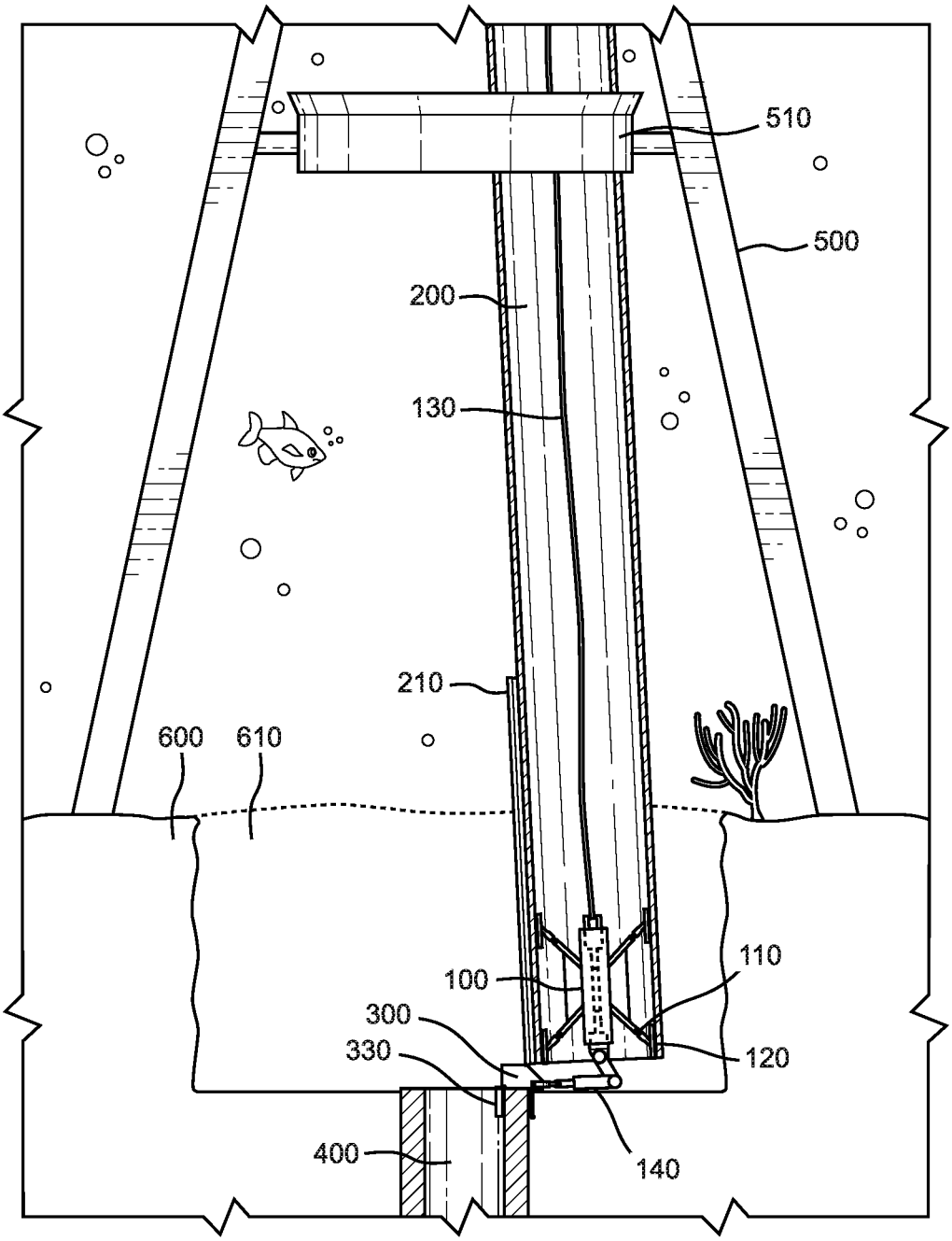
Figure 16A:
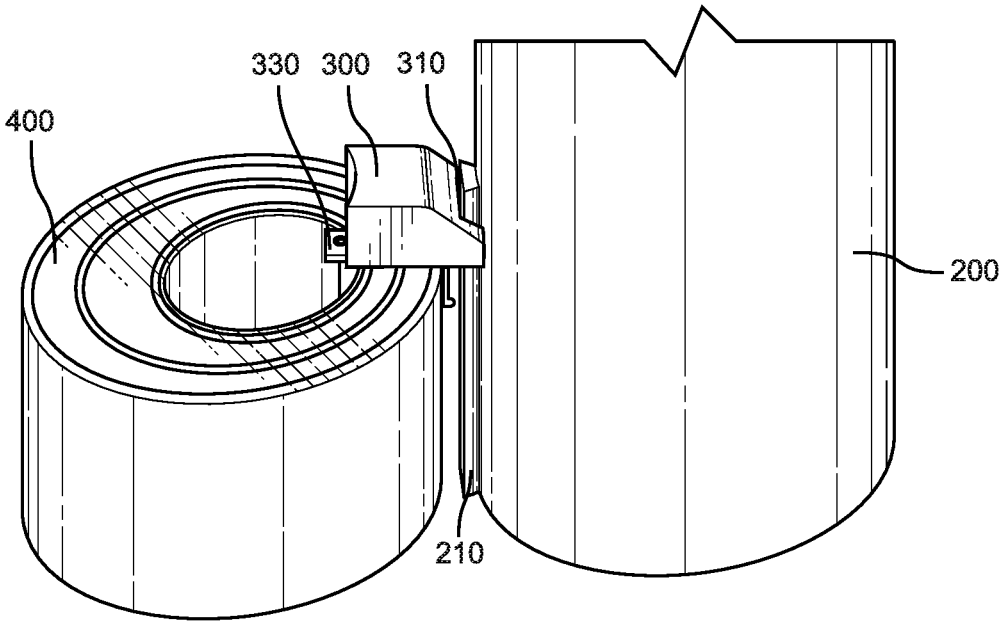
FIG. 16A illustrates a perspective side view of the conductor pipe and with a dovetail cutout mated with the dovetail fin of the stump block, thereby bypassing the old well stump, with respect to the method operation shown in FIGS. 10-15.
Figure 16B:
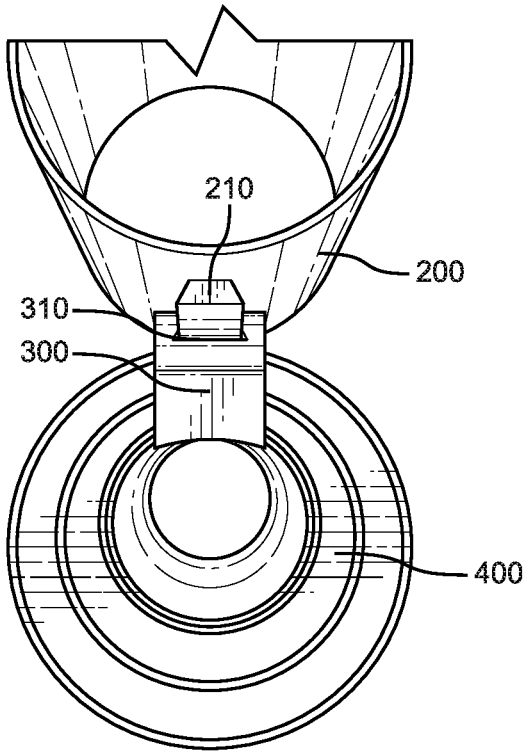
FIG. 16B illustrates a perspective top view of FIG. 16A.

Still referring to FIG. 10, the conductor pipe 200 has been prepared and fitted with a dovetail fin 210 of the SRT apparatus on its outer exterior and passed vertically through a platform guide 510 which is supported by a platform 500 and having reached the old well stump 400 which is shown below the seafloor 600. Here, platform guide 510 assists in positioning the conductor pipe 200 near the general vicinity of (or centered with) the old well stump 400. Next, as shown in FIG. 11, the manipulator arm 140 (with stump block 300 connected thereto) can be moved and articulated such that clamp, grippers, or forceps 330 of SRT 100 grasp the outer and inner edge or lip of old well 400, thereby securing clamp 330 to the old well stump 400. Next, as shown in FIG. 12, the manipulator arm 140 can then be actuated to articulate its arm in order to bend at a joint or elbow thereby moving and pivoting the conductor pipe 200 laterally, transversely, angularly, or sideways to clear and bypass the old well stump 400. Next, as shown in FIG. 13, the manipulator arm 140 can then actively pull the conductor pipe 200 in a downward angled direction to mate or engage the dovetail fin 210 with that of the dovetail cutout, groove, or channel 310 of the stump block 300. Here, it is contemplated within the scope of the disclosure that various cameras or proximity sensors may be deployed on the body of SRT 100 (or in the vicinity thereof) to allow an operator (or autonomous system) to accurately align the fin 210 with that of cutout 310. Specifically, as shown in FIGS. 16A-16B, dovetail cutout 310 can be comprised of a channel or groove female member having a triangular, trapezoidal, or spherical cross-section configuration that corresponds with a same or similar triangular, trapezoidal, or spherical configuration male member of fin 210. Moreover, the opening of cutout 310 may also be slightly larger to allow for easier engagement with fin 210, but still prevent fin 210 to be pulled or slid out of cutout 310 during the slot recovery operations disclosed herein.

Figure 14:
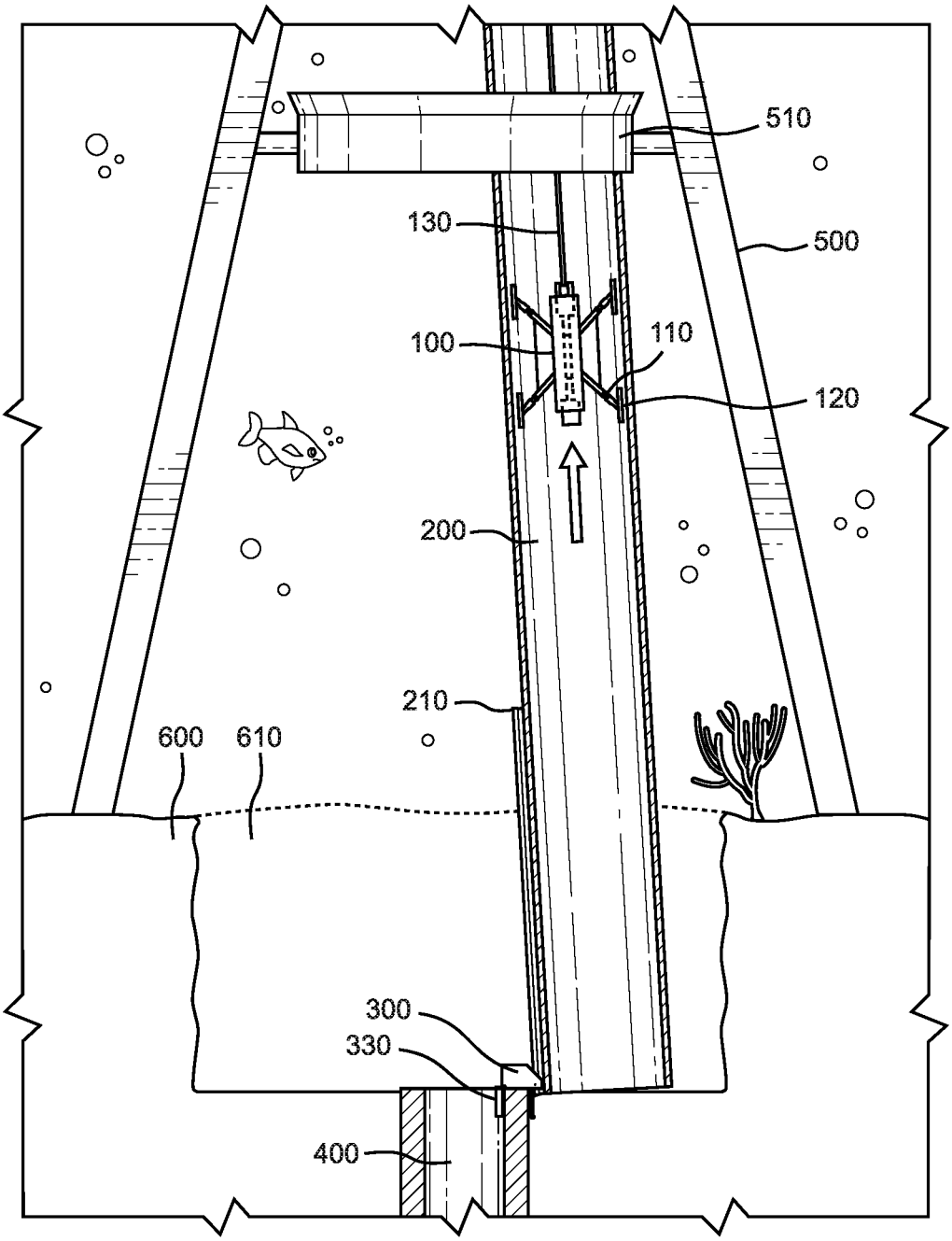
Figure 15:
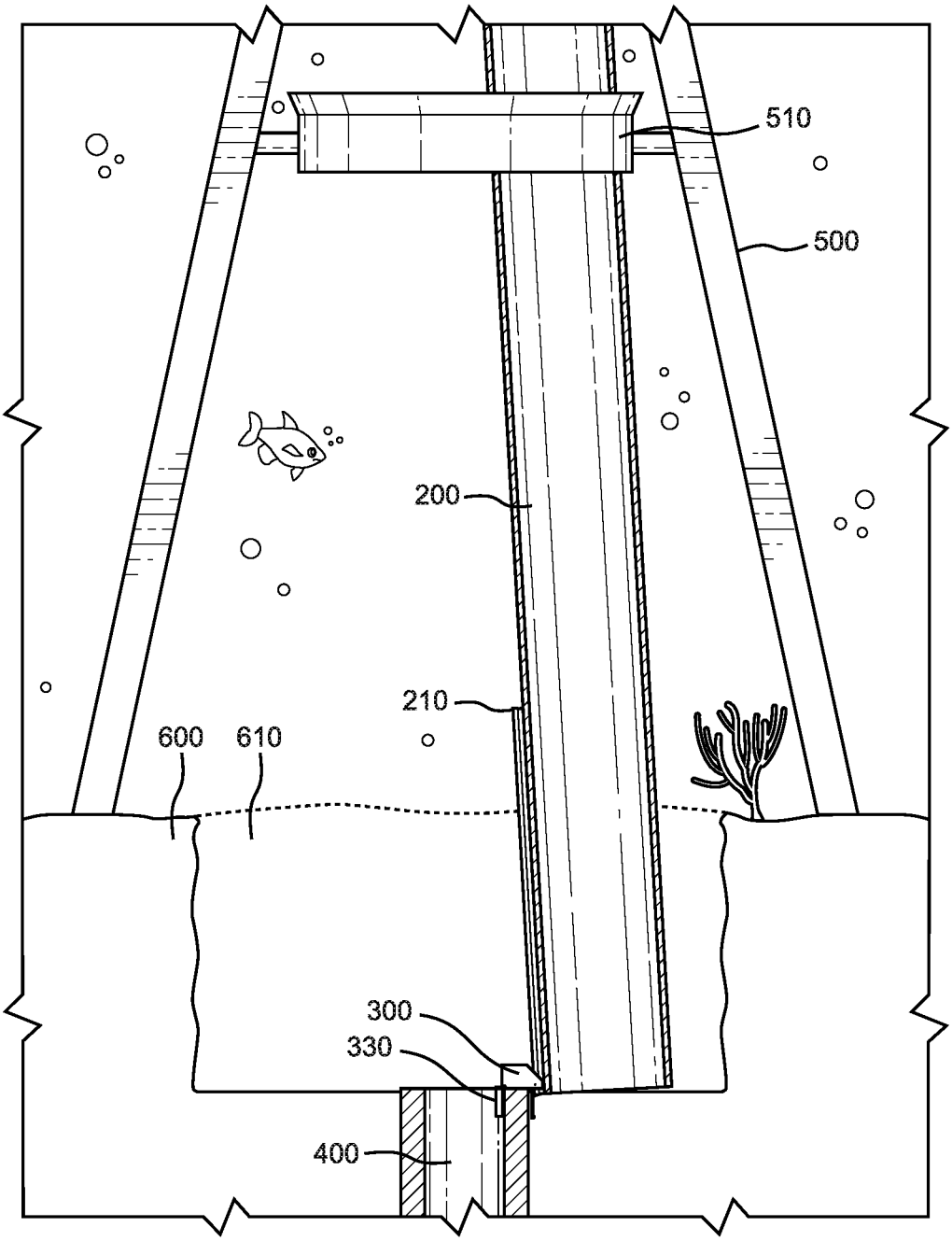

Next, as shown in FIG. 14, once the conductor pipe 200 with dovetail cutout 210 is mated or secured to the dovetail cutout of the stump block 300, bypassing the old well stump 400, then SRT apparatus 100 can then be retrieved. In particular, FIG. 7 shows arm 140 of the SRT apparatus 100 disengaged and decoupled from the stump block 300. Next, its extendable legs 110 are retracted and the foot pads have detached or disengaged from the interior wall space of the conductor pipe 200. Next, the SRT apparatus 100 body can then be pulled up and out of the conductor pipe 200 to the surface by the umbilical 130. In particular, FIG. 15 shows the completed operation of the disclosure described herein of the conductor pipe 200 with dovetail fin 210 mated with the dovetail cutout of the stump block 300, bypassing the old well stump 400, and the SRT apparatus 100 is completely retrieved and no longer visible. Here, as shown in FIG. 15, it is noted there will generally be an angle (inclination) to conductor pipe 200 at the completion of operations, because the new conductor cannot occupy the same space as the old well stump, among other reasons.

FIGS. 16A-16B illustrate various views for the dovetail fin 210 engaged and secured to the stump block 300 of the present disclosure described herein, wherein the fin 210 is slid through opening cutout 310 of the stump block 300. In addition, clamp, gripper, or forceps 330 is shown engaging and securing the inner and outer casings of stump well 400, wherein well 400 is comprised of multiple tubular casings cemented together.

From the foregoing it will be seen that the present disclosure described herein is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. An offshore platform slot recovery tool system, comprising:

a housing, wherein the housing comprises a plurality of support members extending radially from the housing;

an articulating arm at least partially housed within the housing, wherein the articulating arm is disposed in either a retracted configuration or an extended configuration, wherein the housing or articulating arm comprises one or more cameras or sensors adapted to capture video, location, azimuth, and inclination data; and a bracket coupled to a distal end of the articulating arm; and a gripping member coupled to the bracket.

2. The offshore platform slot recovery system of claim 1, further comprising a male securement member configured to secure to an exterior surface of a conductor pipe.

3. The offshore platform slot recovery system of claim 2, wherein the bracket of the articulating arm comprises a female securement member configured to receive the male securement member.

4. The offshore platform slot recovery system of claim 3, wherein the female securement member is comprised of a channel or slot.

5. The offshore platform slot recovery system of claim 2, wherein the male securement member is comprised of a groove or track.

6. The offshore platform slot recovery system of claim 2, wherein the male securement member comprises one or more sensors that are capable of measuring and transmitting location, azimuth, and inclination data.

7. The offshore platform slot recovery system of claim 1, wherein each of the extendable supports further comprise feet or gripping members at their distal ends.

8. The offshore platform slot recovery system of claim 1, further comprising a cord or line secured to a top region of the housing, wherein the cord or line is configured to operate and retrieve the housing.

9. The offshore platform slot recovery system of claim 1, wherein the gripping member is comprised of at least one of: a lasso member, encircling member, looped member, forceps, or clamp.

10. An offshore platform slot recovery tool method, comprising:

lowering a housing within a conductor pipe, wherein the housing comprises a plurality of support members extending radially from the housing;

operating the plurality of support members such that they engage an interior surface of the conductor pipe;

deploying an articulating arm from the housing, and operating a gripping member coupled to the articulating arm such that the gripping member couples to a seafloor oil well casing, wherein the conductor pipe is moved in a direction away from the seafloor oil well casing via the articulating arm.

11. The offshore platform slot recovery method of claim 10, further comprising a male securement member secured to an exterior surface of the conductor pipe.

12. The offshore platform slot recovery method of claim 11, receiving, via a female securement member, the male securement member.

13. The offshore platform slot recovery method of claim 10, further comprising obtaining location, azimuth, and inclination data from one or more cameras or sensors.

14. The offshore platform slot recovery method of claim 10, further comprising operating and retrieving the housing via a cord or line secured to a top region of the housing.

15. The offshore platform slot recovery method of claim 10, wherein the step of operating a gripping member of the articulating arm further comprising at least partially encircling an exterior surface of the seafloor well casing with the gripping member, wherein the gripping member is comprised of at least one of a lasso member, encircling member, looped member, forceps, or clamp.

16. The offshore platform slot recovery method of claim 15, decoupling the gripping member from the articulating arm.

* * * * *